US005355708A

United States Patent [19]

Kauffman

[11] Patent Number: 5,355,708

[45] Date of Patent: Oct. 18, 1994

[54] STRAIGHT ROD STOCK PROCESSOR

[76] Inventor: Kenneth A. Kauffman, R.D. #12, Pisgah Rd., York, Pa. 17406

[21] Appl. No.: 170,611

[22] Filed: Dec. 20, 1993

[51] Int. Cl.[5] ..... B21D 7/022

[52] U.S. Cl. ..... 72/294; 72/307; 72/217; 72/7; 226/187

[58] Field of Search ..... 72/307, 306, 294, 217–219, 72/388, 7; 226/186, 187, 184, 183

[56] References Cited

U.S. PATENT DOCUMENTS

| | | | |
|---|---|---|---|
| 1,048,049 | 12/1912 | Darnell | 140/140 |
| 1,096,857 | 5/1914 | Pederquist | 226/193 |
| 1,728,109 | 9/1929 | Dalheimer | 140/140 |
| 2,525,590 | 10/1950 | Collins | 226/186 |
| 2,925,170 | 2/1960 | Rath | 226/186 |
| 3,680,347 | 8/1972 | Schenck | 72/217 |
| 4,235,362 | 11/1980 | Hubenko | 226/193 |
| 4,280,350 | 7/1981 | King | 72/307 |
| 5,193,378 | 3/1993 | Ritter et al. | 72/294 |
| 5,228,322 | 7/1993 | Del Fabro | 72/307 |
| 5,285,671 | 2/1994 | Del Fabro | 72/307 |

FOREIGN PATENT DOCUMENTS

| | | | |
|---|---|---|---|
| 23233 | 6/1962 | Fed. Rep. of Germany | 226/193 |
| 2553314 | 10/1984 | France . | |

*Primary Examiner*—Daniel C. Crane
*Attorney, Agent, or Firm*—Samuel M. Learned, Jr.

[57] ABSTRACT

A straight rod stock processor and method for use thereof which incorporates the employment of a rod stock loader to effect automatic shakeout of a piece of straight rod stock in pulling the same from a pre-load bundle of infeed stock and delivery to a set of secondary rod stock compression rollers interposed between the rod stock loader and a stirrup bender just forward of the stirrup bender head on the infeed side thereof so that essentially the entire length of an infed rod stock piece may be thereby positioned and controlled in delivery to the stirrup bender head for processing thus substantially reducing labor and waste and handling costs per ton which are otherwise normally associated with the processing of straight rod stock lengths through a stirrup bender.

7 Claims, 4 Drawing Sheets

Fig. 5
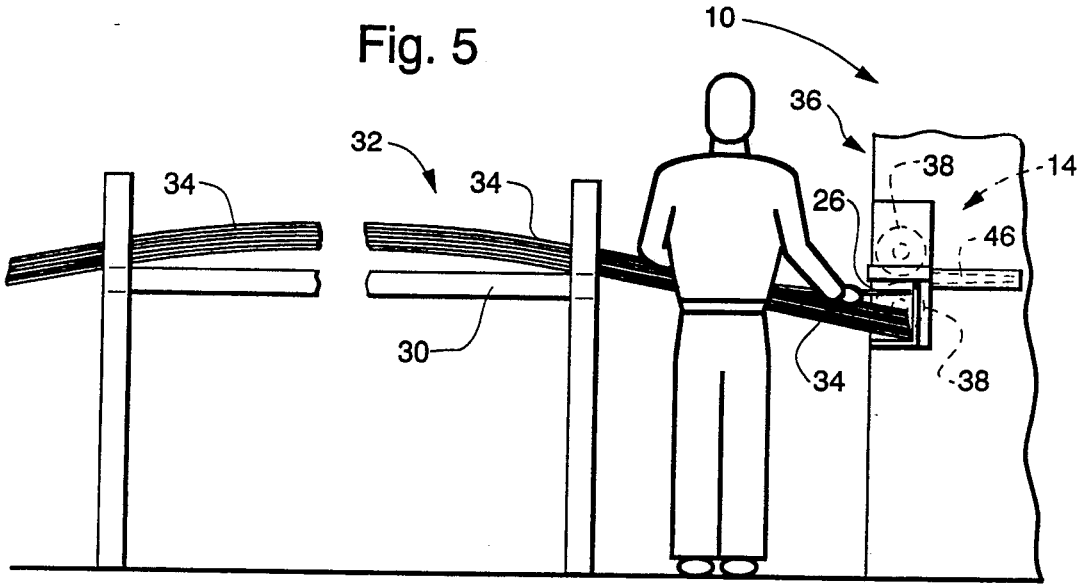
Fig. 6
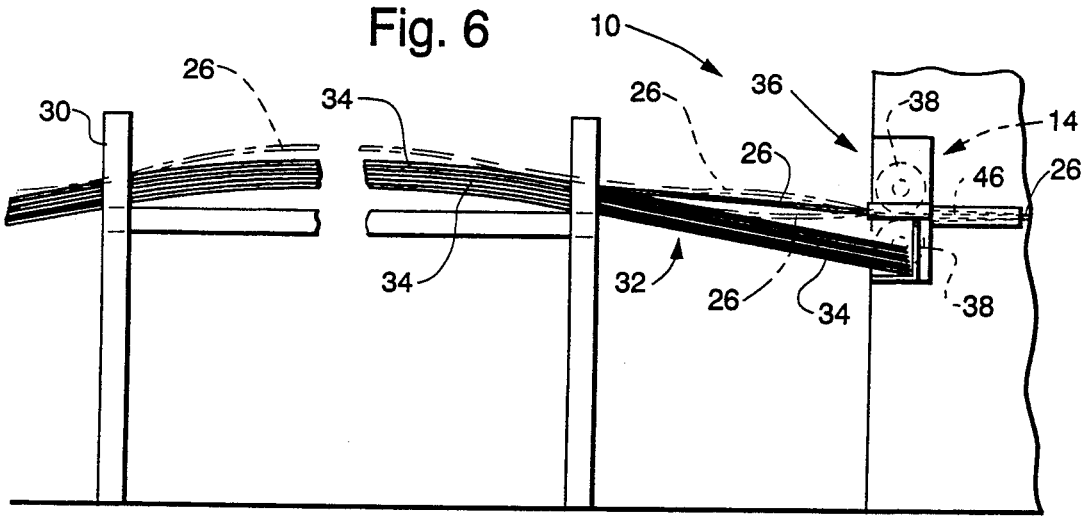
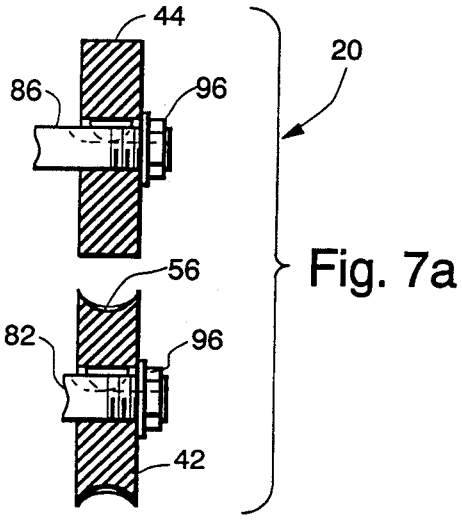
Fig. 7a
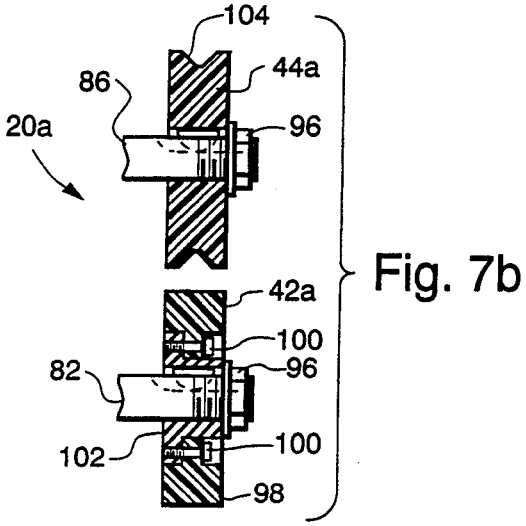
Fig. 7b

STRAIGHT ROD STOCK PROCESSOR

BACKGROUND OF THE INVENTION

The present invention relates to an improvement in straight rod stock processors of that type employed for the shearing and bending of concrete reinforcing bar, and in particular is the electro-mechanical combination of a rod stock loader with a stirrup bender, being distinguished, however, by the incorporation of a set of secondary rod stock compression rollers positioned just forward of the stirrup bender shear blade in order to pick-up and infeed that three-to-five foot length of rod stock remaining between the loader feed compression drive wheels and the stirrup bender shear blade, so that essentially the entire length of a piece of straight rod stock is delivered to the bender head for making product thus minimizing waste and handling, and making the processing economies of using lower cost per ton straight rod stock for producing concrete reinforcing shapes competitive with that of the coil-fed stirrup benders.

Exemplary of the coil-fed stirrup benders is that as taught by Ritter et al in U.S. Pat. No. 5,193,378 dated Mar. 16, 1993, wherein reinforcing bar material is infed from a coil (not shown) by a set of compression feed rollers 4 through measuring rollers 11 to a series of straightening rollers 5 to remove the coil bend and furnish a straight rod length segment for delivery to the shear station 8 and bender head 9 whereby bending of product (stirrups) B is accomplished. The distance between the straightening rollers 5 and the shear station 8 in such machines is typically three-to-five feet, which is the length of the waste tail at the end of processing a thousand-foot or so coil of reinforcing bar material, and in terms of total length of the coil processed is not a substantial amount of waste. Therefore, although the cost per ton of coil material is higher, the handling efficiencies and relatively low waste make such an alternative competitive with the lower cost per ton straight rod stock. Thus, when one is infeeding forty to sixty-foot lengths of straight rod stock through such a machine, and there is a three-to-five foot piece of waste for each piece of straight rod stock thus fed for processing, the cumulative waste amount quickly becomes substantial and with the increased handling requirements involved with piece-feeding affects even more substantially the otherwise lower material cost advantage of using straight rod stock.

Another technique for infeeding coil stock to a stirrup bender is by a reciprocating gripper means as taught by DelFabro et al in Fr. Pat. No. 2,553,314 dated Apr. 19, 1985, as therein illustrated in FIG. 1. Again, however, were such a machine used for infeeding and processing pieces of straight rod stock similar production efficiency, waste consideration, and material cost differential factor results would obtain as heretofore described.

The applicant herein, by his invention provides a machine combination and method which overcomes those above-identified offsetting factors which otherwise mitigate against competitive use of straight rod stock as opposed to coil stock in the stirrup bending of concrete reinforcing bar shapes.

SUMMARY OF THE INVENTION

It is the principal object of the present invention to provide a straight rod stock processor comprised of a stirrup bender coupled to a rod stock loader wherein a set of secondary rod stock compression rollers are interposed between the loader and bender just forward of the stirrup bender shear blade on the infeed side thereof as a rod stock positioning and control means whereby essentially the entire length of an infed rod stock piece may be delivered to the stirrup bender head for processing.

It is another object of the present invention to provide a straight rod stock processor which incorporates an infeed method for accomplishing automatic shakeout of a piece of straight rod stock to pull it from the preload bundle of infeed stock once the end of that piece of straight rod stock is engaged with the loader feed compression drive wheels for delivery to the stirrup bender.

It is also an object of the present invention to provide a straight rod stock processor that substantially reduces the labor and waste and handling costs per ton otherwise normally associated with the processing of straight rod stock lengths through a stirrup bender or a standard shearline.

It is a further object of the present invention to provide a straight stock rod processor that is of durable construction and easily operated by persons of ordinary skill.

The foregoing, and other objects hereof, will be readily evident upon a study of the following specification and accompanying drawings comprising a part thereof.

BRIEF DESCRIPTION OF THE DRAWINGS

FIG. 5 is a simplified side elevation view showing manual loading of a piece of straight rod stock from the pre-load bundle to the rod stock loader.

FIG. 6 is a simplified side elevation view showing automatic shakeout of the infed rod stock piece from the pre-load bundle.

Figure 3:
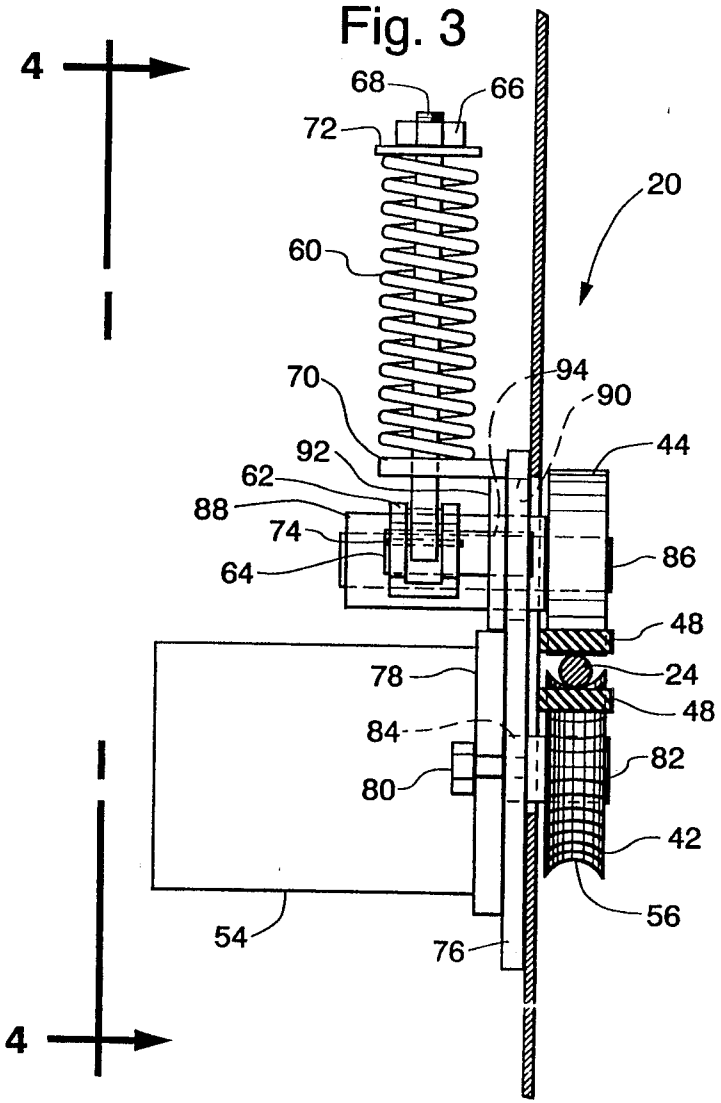
FIG. 3 is an enlarged end elevation view of the set of secondary rod stock compression rollers, as shown in FIG. 2 and seen along the line 3—3 thereof.

FIG. *7a* is a cross sectional end elevation view of a set of metal secondary rod stock compression rollers as seen in FIG. 3.

FIG. *7b* is a cross sectional end elevation view of a replacement set of pliable composition secondary rod stock compression rollers which may be alternately employed in place of the aforementioned metal rollers.

DETAILED DESCRIPTION OF THE INVENTION

Figure 1:
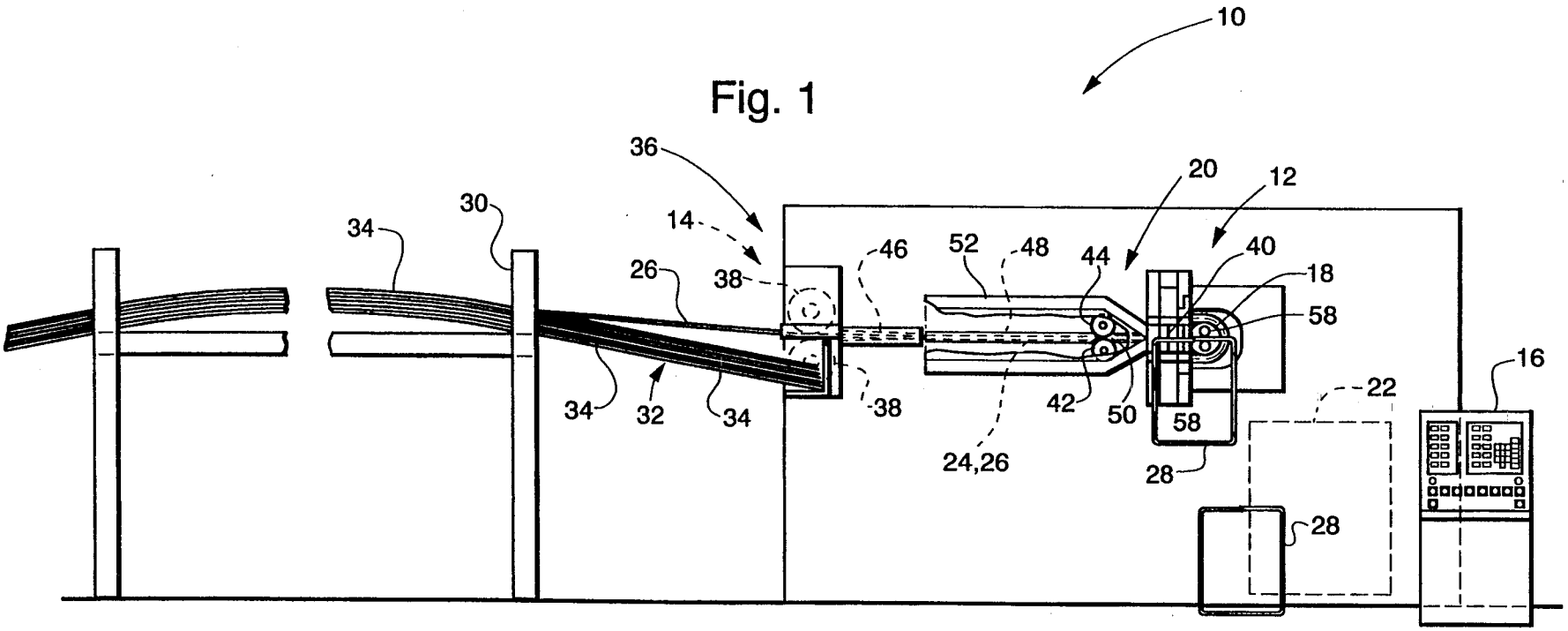
FIG. 1 is a simplified side elevation view of the component parts comprising the straight rod stock processor of instant invention.

Referring to FIG. 1, the straight rod stock processor 10 of present invention and the component parts thereof comprising the same are shown in a simplified side elevation view, which component parts consist of a stirrup bender 12 mechanically and electronically interconnected to a rod stock loader 14 through a processor control 16 which integrates powering and operation of the loader 14 with powering and operation of a stirrup bender head 18 cooperatively through a set of secondary rod stock compression rollers 20 by a drive motor 22, whereby functionally the processor is mechanically adapted by means of said set of secondary rod stock compression rollers 20 to stabilize for delivery the tail length 24 of an infed rod stock piece 26 to the stirrup bender head 18 for in-line fabrication into a bent rod product piece 28. The processor 10 is further provided with a cooperative rod stock rack 30 whereby a preload bundle 32 of individual rod stock pieces 34 may be positioned at the infeed side 36 of said processor 10 for manual loading of a rod stock piece 26 thereto by means of engagement thereof with said loader 14.

Referring again to FIG. 1 to explain in greater detail the novel features of the present invention, wherein the essence thereof is to provide a set of secondary rod stock compression rollers 20 whereby the tail length 24 of an infed rod stock piece 26 may be stabilized and driven in delivery thereby to the stirrup bender head 18 for processing into a bent rod product piece 28, without either being ejected as scrap or requiring the recovery and rehandling thereof for reprocessing, wherein the tail length 24 is herein defined as that length of an infed rod stock piece 26 remaining at the end of forwarding which extends from inside the set of loader compression drive wheels 38 of the rod stock loader 14 to the stirrup bender shear blade 40. The set of secondary rod stock compression rollers 20, both the structure and operation of which will be hereinafter more particularly illustrated and fully explained, consist primarily of a secondary rod stock drive roller 42 and a spring biased compression roller 44.

Operation of the stirrup bender 12 by means of the processor control 16 to effect driving and functioning of the rod stock loader 14 and stirrup bender head 18 through the drive motor 22 are well established in the art and will not be herein described in greater detail than that which is necessary to explain operation of the set of secondary rod stock compression rollers 20.

In order to facilitate delivery of a manually infed rod stock piece 26 for processing, as well as the forwarding of a tail length 24, both a shielded rod stock infeed channel 46 to direct an infed rod stock piece 26 to the rod stock delivery channel 48 are provided for controlled and directed input to the set of secondary rod stock compression rollers 20, in addition to a stirrup bender delivery channel 50 for continued directed and driven forwarding of either an infed rod stock piece 26 or a tail length 24 from the set of secondary rod stock compression rollers 20 through the stirrup bender shear blade station 40 and into the stirrup bender head 18. The delivery channel safety shield 52 provides worker protection in the event a forwarding rod stock piece 26 or tail length 24 jumps the delivery channels 48 or 50.

The individual rod stock pieces 34 herein illustrated may be any rod material of a thickness and length typical of that type which can be conveniently bent into shapes within the normal operational range and capability of a stirrup bender 12, which rod stock in the case of instant illustration is to be understood as being uncoated concrete reinforcing bar, that in the alternative may be coated with an epoxy resin to prevent corrosion. In the foregoing regard and in the initial illustration and description of the straight rod stock processor 10 of instant invention it is to be further understood that the secondary rod stock compression rollers 20 of said processor 10, being the secondary rod stock drive roller 42 and spring biased compression roller 44, are of that type specifically adapted for use with the forwarding and processing of uncoated reinforcing bar material and as such are different in both structure and finish from those secondary rod stock compression rollers 20 employed for use with the forwarding and processing of coated reinforcing bar material as will hereinafter be illustrated and more fully described.

Figure 2:
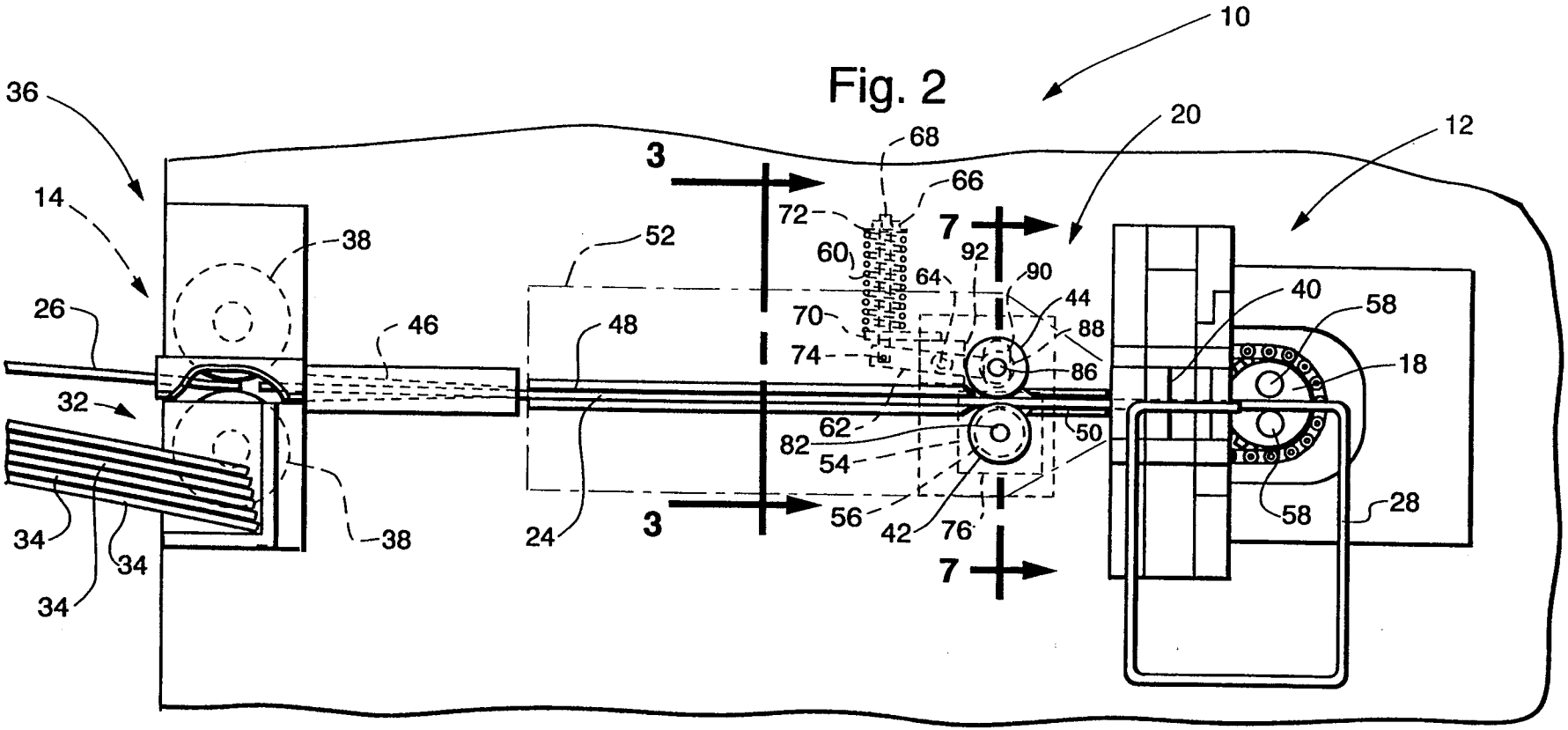
FIG. 2 is an enlarged side elevation view showing in greater detail cooperative functioning of the set of secondary rod stock compression rollers.

Referring now to FIG. 2 to explain in greater detail the structure and functioning of the set of secondary rod stock compression rollers 20 as they are employed in the straight rod stock processor 10. It will be noted in FIG. 2 that a bent rod product piece 28 has just been completed and separated from the tail length 24 by means of the stirrup bender shear blade 40, wherein the bent rod product piece 28 is shown at that moment just prior to the discharge thereof from the stirrup bender head 18. It will also be noted at this point that the tail piece 24, which is of a length appropriate to form another bent rod product piece extends in elongated dimension from the outboard face of the stirrup bender shear blade 40 to the inboard side of the rod stock loader station 14 and is compressively engaged between the set of secondary rod stock compression rollers 20 within that interval of opening between the rod stock delivery channel 48 and the stirrup bender delivery channel 50. Absent incorporation of the set of secondary rod stock compression rollers 20 the infeeding rod stock piece 26, upon the forwarding thereof through the rod stock loader station 14, would engage and eject the tail length 24 which is thereafter normally treated as scrap, but in any event would have to be rehandled for reprocessing in the event another bent rod product piece 28 were to be fabricated therefrom. With incorporation of the set of secondary rod stock compression rollers 20, however, the tail length 24 is stabilized and controlled thereby within the channels 46, 48 and 50, and infed to the stirrup bender head 18 for further bent rod product forming after discharge of the previously formed bent rod product piece 28 and ahead of the forwarding infeed rod stock piece 26. Thus, an additional bent rod product piece 28 is formed from the tail length 24 of each infed rod stock piece 26, without the need or necessity for rehandling and reprocessing, or the consignment thereof to scrap.

Considering now additional structural and operational details of the set of secondary rod stock compression rollers 20 as shown in FIG. 2. As previously pointed out, the rollers 20 shown in FIG. 2 are of a type adapted to handle forwarding of uncoated rod stock 26, and as such are constructed of steel. In this embodiment the secondary rod stock drive roller 42, rotationally driven by the secondary rod stock drive roller motor 54, is provided with a serrated circumferential groove 56 that receivably engages rotationally against the spring biased compression roller 44 in an interposed manner therebetween either an infeed rod stock piece 26 or a tail length 24 and propells the same forward through the stirrup bender shear blade station 40 and into the bend pins 58 of the stirrup bender head 18. Thus, it is the added drive and control provided by the set of secondary rod stock compression rollers 20 which enables production processing of the tail lengths 24 into bent rod product pieces 28 rather than being scrapped or requiring rehandling for reprocessing.

It will be noted that the spring biased compression roller 44 is an idler roller which has a compressive force provided by compression spring 60 operating through a lever arm 62 about pivot pintle 64. The compressive force of roller 44 is adjustable by means of moving a nut 66 upon the threaded spring shaft down or up to either increase or decrease compression of said spring 60 against the compression plate 70 which operates against the washer 72 thereby in turn to increase or decrease compressive force upon said lever arm 62 through pivotal connection of the spring shaft 68 to the lever arm 62 by means of pivotal connection pin 74 so as to accommodate different rod stock piece thicknesses as well as differing operational handling characteristics of the same during forwarding thereof.

Figure 4:
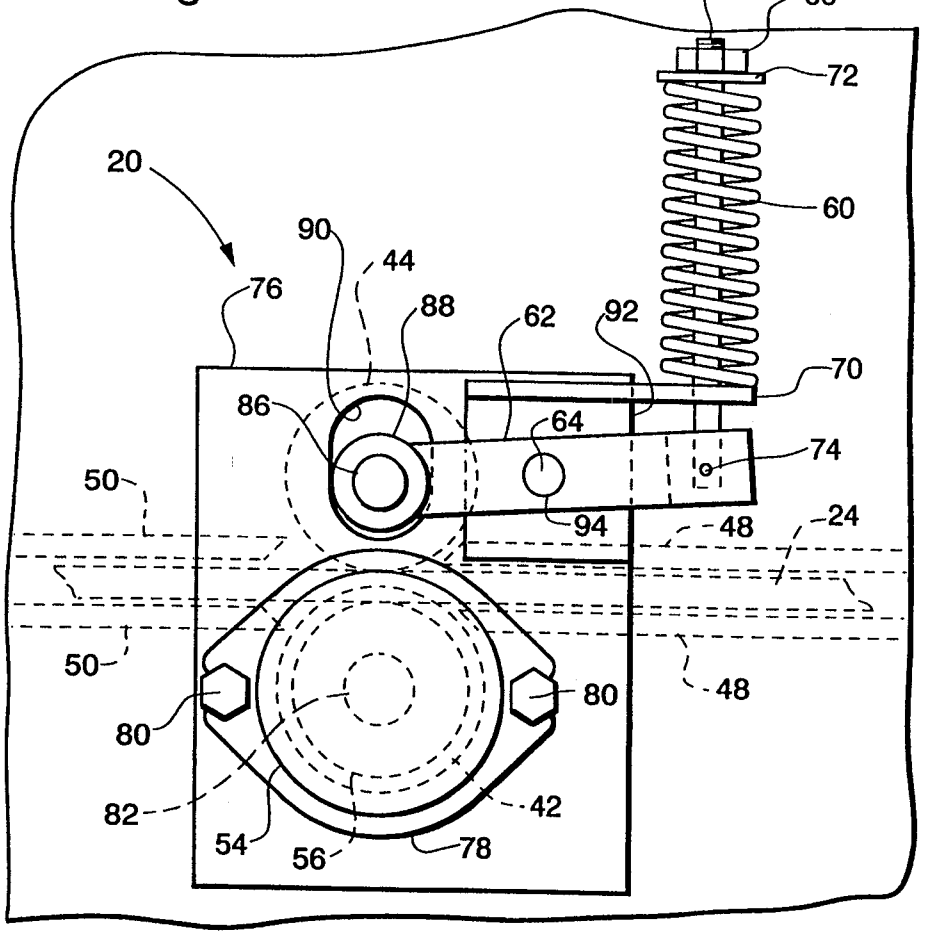
FIG. 4 is a side elevation view of the set of secondary rod stock compression rollers, as shown in FIG. 3 and seen along the line 4—4 thereof.

Referring now to FIGS. 3 and 4 in a contemporaneous consideration thereof for a yet more detailed description of the structure and operation of the set of secondary rod stock compression rollers 20. As therein illustrated, the motor 54 is assembled to the compression roller mounting plate 76 by means of a motor mounting collar 78 which is in turn assembled to said plate 76 with a set of motor collar mounting bolts 80. The motor drive shaft 82, communicating through a motor drive shaft opening 84 in the plate 76, mounts the drive roller 42 which is rotated thereby in direct drive off the motor 54.

The cooperatively acting spring biased compression roller 44 of the set of secondary rod stock compression rollers 20 is assembled to an idler shaft 86 which rotates within the idler shaft bearing sleeve 88 being in turn assembled to the end of the lever arm 62. It will be noted, particularly as shown in FIG. 4, that the compression roller mounting plate 76 is further provided with an oblong idler shaft bearing sleeve deflection opening 90 therein whereby the spring biased compression roller 44 is enabled to accommodate rod stock 26 and tail length 24 thickness and operational handling irregularities by resilient pivotal deflection of the idler shaft bearing sleeve 88 upon the lever arm 62 about pivot pintle 64 within the confines of said oblong opening 90. Also shown in FIGS. 3 and 4 is the compression plate mounting block 92 to which the compression plate 70 is attached, and which also in cooperation with the compression collar mounting plate 76 provides an additional bearing surface thickness for the pivot pintle 64 through pivot pintle bearing opening 94.

Directing attention to FIG. 3, and assuming the forwarding of a section of tail length 24, it can be seen that the tail length 24 section is compressively engaged between the drive roller 42 which is provided with a serrated circumferential groove 56, and the spring biased compression roller 44. In this compressive engagement condition, as has been previously described, the tail length 24 section is both controlled and moved forward through the stirrup bender shear blade station 40 and into engagement with the bend pins 58 of the stirrup bender head 18 for production of a bent rod product piece 28, the foregoing of which is also illustrated in FIG. 4.

Considering now the views shown in FIGS. 5 and 6, which illustrate the automatic shakeout feature whereby an infed rod stock piece 26 is machine vibrated, removed, and automatically infed through the loader feed compression drive wheels 38. In previous manual loading operations it has been the customary practice for an operator to manually withdraw and free an individual rod stock piece 34 from a pre-load bundle 32, a process known as "shaking out", which required both substantial time and physical effort on behalf of the operator. However, it has been found, in use of the straight rod stock processor 10 of instant invention, that if the operator simply withdraws and inserts the infeed side 36 end of an infed rod stock piece 26 into engageable communication within the loader feed compression drive wheels 38, then a vibratory infeed motion is set up within the subject infed rod stock piece 26 and there is an "automatic shakeout" and infeed withdrawal thereof from the pre-load bundle 32 as shown in FIG. 6. This is the phenomenon of the process denomenated as "automatic shakeout".

Directing attention finally to FIGS. *7a* and *7b*, which respectively illustrate greater detail of the steel secondary rod stock drive roller 42 and spring biased compression roller 44 as heretofore shown and described for the forwarding of bare steel rod stock pieces, and the replacement set of pliable secondary rod stock compression rollers 20*a* having a resilient material secondary rod stock drive roller 42*a* and resilient material spring biased compression roller 44*a* for the forwarding of epoxy coated rod stock pieces so as not to damage the epoxy coating during the forwarding operations, wherein it is to be noted that the respective sets of steel and resilient material secondary rod stock compression rollers 20 are interchangeable upon the drive and idler shafts 82 and 86 depending on whether bare steel or epoxy coated rod stock material is being handled. The respective steel 42 and 44 rollers and the resilient material 42*a* and 44*a* rollers are interchangeable by means of a compression nut and washer assembly 96 as shown. It will also be noted that in the case of the replacement set of pliable secondary rod stock compression rollers 20*a*, due to the softer resilient material construction and reduced wear characteristics thereof, the resilient material facing 98 is replaceable by means of assembly thereof with connection bolts 100 to the resilient material drive roller mandrel 102. Also, in the case of resilient material rollers, for the purpose of improved rod stock operational handling as well as roller wear characteristics, the workpiece engagement face of the spring biased compression roller is provided with a resilient rod stock engagement groove 104 whereas the workpiece engagement face of the drive roller 42*a* is flat.

Although the straight rod stock processor invention hereof, the structural characteristics and method of employment thereof, respectively have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

I claim:

1. A straight rod stock processor adapted to produce bent rod product pieces, said processor comprising in combination a stirrup bender head mechanically linked to a rod stock loader being electronically integrated one with the other by means of a processor control, said rod stock loader having means to support a bundle of individual straight rod stock, a set of loader compression drive wheels of said rod stock loader adapted to compressively engage and infeed rod stock from said loader into a channel means adapted to guide an individual infed rod stock piece from said rod stock loader to said bender head of said rod stock processor, a shear blade of said rod stock processor adjacent said bender head at the bender head terminal end of said channel means, and a set of secondary rod stock compression rollers comprised of a drive roller provided with a serrated circumferential groove and rotated by a direct drive motor electronically integrated with said processor control and an automatically adjustable spring biased variably set flat faced compression roller being an idler roller interposed within said channel means between said set of loader compression drive wheels of said rod stock loader and said shear blade of said rod stock processor, said set of secondary rod stock compression rollers cooperatively adapted to compressively engage and forward to said bender head a tail length of said individual infed rod stock piece for the processing thereof into a bent rod product piece.

2. A straight rod stock processor according to claim 1 wherein said individual infed rod stock piece is bare steel reinforcing bar.

3. A straight rod stock processor according to claim 1 wherein said set of secondary rod stock compression rollers are constructed of steel.

4. A straight rod stock processor according to claim 1 wherein said steel set of secondary rod stock compression rollers are interchangeable with a replacement set of pliable secondary rod stock compression rollers.

5. A straight rod stock processor according to claim 1 wherein said individual infed rod stock piece is epoxy coated reinforcing bar.

6. A straight rod stock processor according to claim 4 wherein said replacement set of pliable secondary rod stock compression rollers are comprised of a resilient material spring biased compression roller and a rod stock drive roller having a resilient material facing.

7. A straight rod stock processor according to claim 6 wherein said resilient material facing upon said rod stock drive roller is replaceable.

* * * * *